United States Patent [19]

Vermeulen et al.

[11] Patent Number: 5,043,245

[45] Date of Patent: Aug. 27, 1991

[54] PROCESS FOR THE PRODUCTION OF A LAMINATED ARTICLE

[75] Inventors: Leon L. Vermeulen, Herenthout; Robert S. Pauwels, Brasschaat; Piet Kok, Ghent; Jean-Marie O. Dewanckele, Drongen, all of Belgium

[73] Assignee: AGFA Gevaert, N.V., Mortsel, Belgium

[21] Appl. No.: 470,353

[22] Filed: Jan. 25, 1990

[30] Foreign Application Priority Data

Jan. 31, 1989 [EP] European Pat. Off. ..... 89200203.1

[51] Int. Cl.[5] ..... G03C 5/54

[52] U.S. Cl. ..... 430/247; 430/232; 430/233; 430/248; 430/965

[58] Field of Search ..... 430/248, 203, 233, 965, 430/247

[56] References Cited

U.S. PATENT DOCUMENTS

| | | | |
|---|---|---|---|
| 3,160,505 | 12/1964 | Willems et al. | 430/248 |
| 3,360,368 | 12/1967 | Van Veelen et al. | 430/233 |
| 3,565,619 | 2/1971 | Johnson | 430/248 |
| 3,671,242 | 6/1972 | Liebe et al. | 430/233 |
| 3,833,372 | 9/1974 | Hayashi et al. | 430/233 |
| 4,908,286 | 3/1990 | Vervloet et al. | 430/233 |

*Primary Examiner*—Richard L. Schilling

*Attorney, Agent, or Firm*—William J. Daniel

[57] ABSTRACT

Process for the production of a laminated article including a sheet support bearing a silver image produced by the silver complex diffusion transfer process in a layer containing developement nuclei, wherein such supported image is heat-laminated with a protective thermoplastic resin layer of sheet that covers it. The heat-lamination of the nuclei-containing layer with the silver image therein takes place in the presence of at least one of certain heterocyclic black-toning agents which are effective to prevent degradation of the neutral black coloration and density loss of the silver image as a result of heat-lamination.

10 Claims, No Drawings

PROCESS FOR THE PRODUCTION OF A LAMINATED ARTICLE

DESCRIPTION

The present invention relates to a process for producing a laminated article incorporating a silver image between heat-sealed elements.

The increasing importance in our present-day society of personal identification of holders of passports, licenses, buyers' credit cards, membership cards, etc., makes it necessary to manufacture identification documents that are accurate in data representation, durable and protected against forgery.

Many identification documents display the name, personal data and the signature of the bearer, but for still better identification the document includes a portrait of the bearer. As far as textual matter is concerned, it is usually written or printed in black-and-white while the photograph is either in black-and-white or in colour. Black-and-white photographs based on silver metal are more durable than colour photographs and are in many cases preferred over colour portraits the colours of which may change and make identification somewhat confusing.

According to a very convenient method a black-and-white photograph for the production of identification documents is made according to a method known as silver complex diffusion transfer reversal (DTR-) processing. The principles of the silver complex diffusion transfer process are known e.g. from the book : "Photographic Silver Halide Diffusion Processes" by André Rott and Edith Weyde—Focal Press—London —New York (1972). The photographic document is sandwiched between a clear plastic protective cover sheet and a rear support sheet. The assembly is laminated together to provide a durable identification document, also called ID card.

The production of the laminated article through the laminating of a protective thermoplastic or thermohardenable sheet covering the information to be protected proceeds advantageously by heating. The heat necessary for a firm lamination gives rise to a problem, particularly when the silver image is produced by the DTR-process, in that the colour of the silver does not remain neutrally black but turns brown giving rise to some fading of the image.

Such phenomenon is objectionable and its negative influence on image quality and image recognition has to be reduced as much as possible.

In DTR-photography the problem of obtaining a silver image with neutral colour tone has been recognized and suitable compounds known as image-tone controlling agents, more particularly black-toning agents have been used to shift the image tone from brown to deep black (ref. the already mentioned book of André Rott and Edith Weyde, pages 58–65).

It has been found experimentally by us, however, that from the various classes of mostly heterocyclic thiol or thione compounds used for said purpose only a limited number are effective black-toning agents in the temperature range (100° to 150° C.) in which heat-sealing for lamination takes place.

It is an object of the present invention to provide a process for the production of laminated articles incorporating a DTR-silver image sandwiched between heat-sealed elements wherein the degrading influence of heat on a neutral colour tone of the silver image is strongly reduced and even eliminated.

It is another object of the present invention to provide a laminated article produced by said process.

Other objects and advantages will become apparent from the further description.

In accordance with the present invention a process is provided for the production of a laminar article including a sheet support bearing a silver image produced by the silver complex diffusion transfer process in a layer containing development nuclei, wherein said image-bearing support is heat laminated with a protective thermoplastic resin layer or sheet that covers said supported silver image, characterized in that said layer containing development nuclei contains said silver image during the heat-lamination procedure in the presence of one or more heterocyclic thione compounds or tautomeric thiol representatives thereof acting as black-toning agents and corresponding to one of the following general or structural formulae (I) to (V):

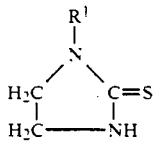
(I)

wherein $R^1$ represents a C1–C4 alkyl group, an allyl group or a phenyl group;

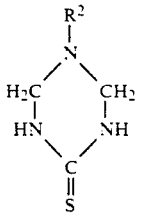
(II)

wherein $R^2$ represents a C1–C4 alkyl group or an allyl group;

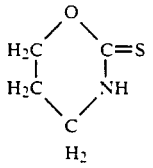
(III)

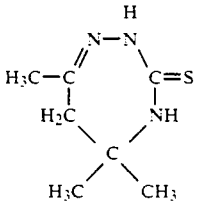
(IV)

-continued (V)

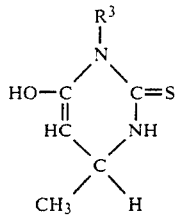

wherein $R^3$ represents a C1–C4 alkyl group or a phenyl group.

Compounds according to general formula (I) can be prepared as described in Ber. 24, 2191 (1891), Canad. J. Chem. 33, 1278 (1955) and GB-P 847,436.

Compounds according to general formula (I) can be prepared as described in U.S. Pat. No. 3,712,818 or GB-P 1,265,886.

Compound (III) can be prepared according to Acta. Chem. Scand. 12, 1751 (1958).

Compound (IV) can be prepared as described in Monatshefte für Chemie 106, 1495 (1975).

Compounds according to general formula (V) can be prepared as described in Belgian Patent No. 574,756.

Particularly suitable black-toning agents according to general formula (I) are these wherein $R^1$ is phenyl, allyl or n-butyl which compounds are called herein compounds No. 1, 2 and 3 respectively.

Particularly suitable black-toning agents according to general formula (11) are these wherein $R^2$ is $—CH_3$, $—C_2H_5$, $n—C_4H_9$ or $—CH_2CH{=}CH_2$, which compounds are called herein compounds 4, 5, 6 and 7 respectively.

Particularly suitable black-toning agents according to general formula (V) are these wherein $R^3$ is phenyl or methyl which compounds are called herein compounds No. 10 and 11 respectively.

The presence of at least one of these heterocyclic compounds in an image-receiving layer containing a DTR-silver image prevents during a heat treatment as applied in thermal lamination the brown colouration of that image and counteracts the decrease in its optical density.

According to one embodiment for carrying out lamination of the silver image made by DTR-processing in the presence of at least one of said black-toning agents, each such agent is incorporated in the coating composition of the development nuclei layer so as to obtain a coverage thereby in the range of 0.0015 $g/m^2$ to 0.0075 $g/m^2$.

According to another embodiment at least one of said black-toning agents is brought into the presence of the silver image by incorporation into the DTR-processed development nuclei containing layer with an aqueous liquid containing said agent(s) in dissolved form, e.g. in a concentration in the range of 0.05 to 0.5 g per liter.

The development nuclei used in the silver complex DTR-image-receiving material are of the kind generally known in the art, e.g. those described in the already mentioned book of André Rott and Edith Weyde, pages 54–56. Particularly suited are colloidal silver and colloidal metal sulphides, e.g. sulphides of silver and nickel and mixed sulphides thereof. In addition to these nuclei and the above black-toning agents the image-receiving material may include in a hydrophilic colloid binder such as gelatin or caseine any other additive known for use in such materials, e.g. a certain amount of silver halide solvent, one or more developing agents, opacifying agents, e.g. pigments, and optical brightening agents.

The image-receiving layer can form part of a separate image-receiving layer(s) of the photographic material.

When the image-receiving layer for forming said integral combination is applied to a common support and remains associated with the silver halide emulsion layer(s) after processing of the photosensitive material, an alkali-permeable light-shielding layer, e.g. containing white pigment particles, is applied between the image-receiving layer and the silver halide emulsion layer(s) to mask the negative image with respect to the positive image as described e.g. in the already mentioned book of André Rott and Edith Weyde, page 141.

According to a preferred embodiment for forming heat-sealable laminates serving as identification cards the image-receiving layer is applied to a thermoplastic resin support, more preferably a polyvinyl chloride resin support which is coated directly with said image-receiving layer.

The term "polyvinyl chloride" in the present invention includes the homopolymer, as well as any copolymer containing at least 50% by weight of vinyl chloride units and including no hydrophilic recurring units.

Vinyl chloride copolymers serving as the support may contain one or more of the following comonomers : vinylidene chloride, vinyl acetate, acrylonitrile, styrene, butadiene, chloroprene, dichlorobutadiene, vinyl fluoride, vinylidene fluoride and trifluorochloroethylene.

The polyvinyl chloride serving as the support may be chlorinated to contain 60–65% by weight of chlorine.

Many properties of polyvinyl chloride and its copolymers are improved by plasticization and their stability can be improved by stabilizers well known to those skilled in the art (see, e.g., F. W. Billmeyer, Textbook of Polymer Chemistry, Interscience Publishers, Inc., New York (1957) p. 311–315)).

The polyvinyl chloride support may contain pigments or dyes as colouring matter e.g. in an amount up to 5% by weight. An opaque white appearance may be obtained by incorporation of white pigments, e.g. titanium dioxide particles.

In order to provide an image-receiving layer that dries rapidly after wet processing and that has a good adherence to an unsubbed polyvinyl chloride support colloidal silica is incorporated therein as binding agent.

Preferably hydrated silica is used as a dispersion having a pH in the range of 8 to 9. The colloidal silica particles have preferably an average grain diameter between 5 and 100 nm. Such silica particles are available in aqueous colloidal dispersions marketed under the commercial names "LUDOX" (trade name of E. I. du Pont de Nemours, Wilmington, Del. U.S.A.), "SYTON"(trade name of Monsanto Chemical Corporation, Boston, Mass. USA), and "KIESELSOL" (trade name of Farbenfabriken Bayer AG, Leverkusen, West-Germany). SYTON X-30 is a trade name for a 30% by weight aqueous dispersion of silica particles having an average size of 25 nm and KIESELSOL 300-F is a trade name for an aqueous dispersion comprising a colloidal silica having an average particle size of 7–8 nm.

For obtaining an image-receiving layer with good water-resistance the colloidal silica is subjected to a cross-linking reaction with at least one siloxane compound within the scope of the following general formula:

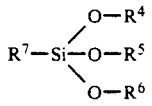

wherein:

each of $R^4$, $R^5$ and $R^6$ (same or different) represents a hydrocarbon group including a substituted hydrocarbon group e.g. methyl and ethyl, and $R^7$ represents a chemical group capable of a polymerization reaction or reactive with respect to amino and/or hydroxyl groups present in proteinaceous material such as gelatin and caseine, more particularly is a group containing reactive halogen such as a reactive chlorine atom, an epoxy group or an alpha,beta-ethylenically unsaturated group, representatives of such groups being e.g. the following:

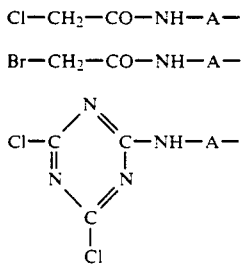

-continued

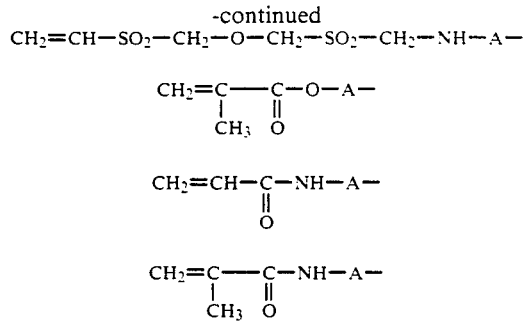

wherein A represents an alkylene group preferably a $C_1$-$C_4$ alkylene group, and

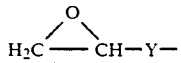

wherein Y is a bivalent hydrocarbon chain including such chain interrupted by oxygen, e.g. a $—CH_2—O(CH_2)_3—$ group, or a bivalent hydrocarbon group that is linked at the side of the silicon atom to oxygen, e.g. is a $—CH_2—O—$ group.

Siloxane compounds according to the above general formula are described in U.S. Pat. No. 3,661,584 and GB-P 1,286,467 as compounds improving the adherence of proteinaceous colloid compositions to glass.

Examples of particularly useful siloxane compounds are listed in the following Table 2.

TABLE 2

1.

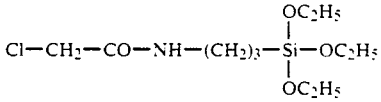

2.

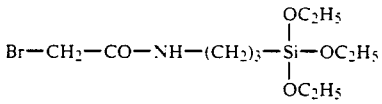

3.

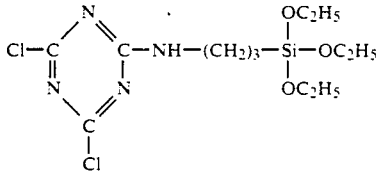

4.

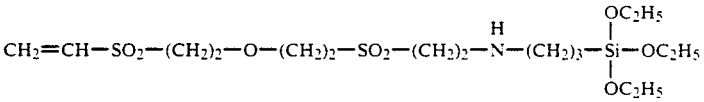

5.

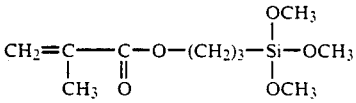

6.

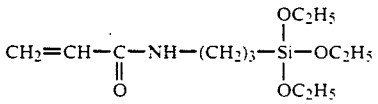

7.

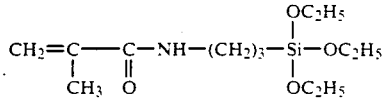

TABLE 2-continued

| | |
|---|---|
| 8. | 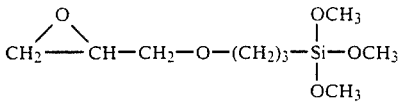 |

The reaction of the siloxane group with the colloidal silica proceeds very rapidly in aqueous medium through a hydrolysis and dehydration reaction, which actually is a condensation reaction with hydrated silica, i.e. $Si(OH)_4$. Full hardening by crosslinking is carried out at elevated temperature after the image formation, e.g. by heating during the heat-sealing lamination step.

By the siloxane group a macrosiloxane is formed with the colloidal hydrated silica according to the following reaction scheme:

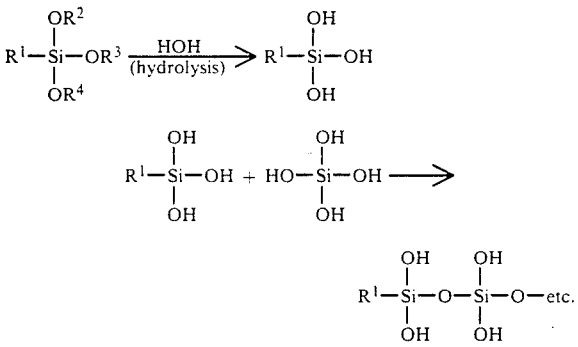

To reduce repellence on coating and to improve coating speed a polyvinyl chloride resin support or polyvinyl chloride coated paper support is pre-treated with a corona discharge by passing the support, e.g. in sheet or belt form, between a grounded conductive roller and corona wires whereto an alternating current (AC) voltage is applied with sufficiently high potential to cause ionization of the air. Preferably the applied peak voltage is in the range of 10 to 20 kV. An AC corona unit is preferred because it does not need the use of a costly rectifier unit and the voltage level can be easily adapted with a transformer. In corona-discharge treatment with an AC corona unit a frequency range from 10 to 100 kHz is particularly useful. The corona treatment can be carried out with material in the form of a belt or band at a speed of 10 to 30 m per min while operating the corona unit with a current in the range of 0.4 to 0.6 A over a belt or band width of 25 cm.

The corona-discharge treatment makes it possible to dispense with a solvent treatment for attacking and roughening the surface of the resin support and is less expensive and more refined in its application.

A corona-discharge surface-treated polyvinyl chloride material serving as a support in the production of a laminated identification card (I.D. card) containing photographic information in a hydrophilic colloid layer is described in U.S. Pat. No. 4,429,032.

A vinyl chloride polymer support may contain pigments or dyes as colouring matter e.g. in an amount up to 5% by weight. An opaque white appearance may be obtained with e.g. titanium dioxide particles.

Usually several sheets of matted polyvinyl chloride having a thickness of only 0.150 to 0.75 mm are stacked and united by lamination so as to reach a sufficient thickness and rigidness suited for introducing the document without distortion in the slot of an electronic identification apparatus.

According to a particularly preferred embodiment, before or during a treatment of the obtained DTR-silver image with at least one black-toning agent the image-receiving layer containing the silver image is treated with an aqueous liquid containing a dissolved surfactant. Said liquid has a cleaning effect and removes organic chemicals stemming from the photographic processing from the image containing layer. In this connection it has been established experimentally by us that residual silver halide developing agent, e.g. hydroquinone, whether it stands in reduced or oxidized state, interferes with an optimum lamination of thermoplastic hydrophobic materials, e.g. in stacking thin layers of such materials forming one thick sheet, more particularly when at least one of these materials is on the basis of a vinyl chloride polymer.

Although any commercial surfactant often called detergent can be used for said purpose, e.g. a detergent described in the book: "McCutcheon's Detergents & Emulsifiers" 1978 North American Edition—McCutcheon Division, MC Publishing Co. 175 Rock Road, Glen Rock, N.J. 07452 USA, preference is given to anionic and non-ionic surface-active agents containing a polyethyleneoxide chain in their structure Examples of such agents are described in U.S. Pat. No. 3,663,229.

A useful concentration of surfactant for the intended purpose of removing residual organic developing agent is in the range of 5 to 50 g per liter.

The cover sheet used in the lamination process is transparent unless the support is already transparent and may be made of any suitable rigid, semirigid or flexible plastic such as a cellulose acetate butyrate, a cellulose triacetate, a polyvinyl chloride, a polymerized polyethylene glycol ester, or polyolefin-coated. A polyethylene-coated polyethyleneglycol terephthalate sheet forms a particularly wear resistant outermost member and is preferred.

According to a preferred embodiment the cover sheet is a polyethylene terephthalate resin sheet coated with a resinous melt-adhesive layer, e.g. a polyalkylene layer, preferably polyethylene layer, having a glass transition temperature at least 40° C. lower than the glass transition temperature of the resin of the support sheet of the laminated article. In this connection reference is made to the Tg values of polyethylene, polypropylene, polyvinyl chloride and polyethylene terephthalate being −20° C., +5° C., +80° C. and +67° C. respectively (see J.Chem. Educ., Vol. 61, No. 8. August 1984, p. 66B).

The lamination of the image-receiving material containing a DTR-silver image and at least one of the black-toning agents according to one of the above formulae (1) to (V) with a covering hydrophobic resin film sheet material proceeds preferably by heat-sealing between flat steel plates or in the nip of pressure rollers under a pressure of, e.g., to 15 kg/cm2 at a temperature in the range of 100° to 150° C., e.g. at 135° C., or by using any other apparatus available on the market for heat-sealing lamination purposes.

According to an embodiment the silver image is formed in an image-receiving layer coated onto an opaque polyvinyl chloride support having a thickness of only 0.150 to 0.75 mm. A sheet of that thickness can still be manipulated easily in a mechanical printing process, e.g. offset or intaglio printing, and before or after being coated with the image-receiving layer can receive additional security marks in the form of e.g. a watermark, finger prints, printed patterns known from bank notes, coded information. e.g. binary code information, signature or other printed personal data that may be applied with fluorescent dyes or pigments, nacreous pigments, and/or visibly legible or ultraviolet-legible printing inks as described e.g. in GB-P 1,518,946 and U.S. Pat. No. 4,105,333.

Other possibilities to increase security against counterfeiting are the inclusion in the laminate of infrared-absorbing markings, magnetic dots or strips and electronic microcircuits hidden from visibility, and holograms as described, e.g., in DE-OS 2 639 952, GB-P 1,502,460 and 1,572,442 and U.S. Pat. No. 3,668,795. The holographic patterns may be obtained in silver halide emulsion layers, normally Lippmann emulsions, especially designed for that purpose and can either or not be combined with a photograph.

According to an embodiment the silver halide emulsion layer for producing the hologram is applied to one side of the transparent cover sheet used in the manufacture of a laminate according to the present invention and laminated together with the image receiving layer either or not separated therefrom by a transparent resin intersheet made of polyethylene or a resin sheet such as a polyvinyl chloride sheet coated with polyethylene.

According to a preferred embodiment an image-receiving layer containing a proteinaceous binding agent, e.g. gelatin or caseine, after forming therein a silver image by silver complex diffusion transfer processing, is treated with a compound serving as hardening agent for its proteinaceous material.

Any hardening agent known to those skilled in the art for hardening gelatin and/or caseine can be used.

Very efficient hardening is obtained with poly-epoxy compounds, particularly a tri-epoxy compound described in DE-OS 2 935 354, especially triglycidyltriazolidin-3,5-dione, and with self-cross-linking reaction products of an epihalohydrin or an Alpha-dihalohydrin with a water-soluble polyamide and water-soluble polyamine as described in GB-P 1,269,381.

Other particularly suitable hardening agents are N-methylol compounds, e.g. the N-methylol based hardening agents described in published Japanese patent application (Kokai) 60 170.841. and resins such as melamine-formaldehyde resins still containing such groups.

The hardening agents are applied preferably from an aqueous composition serving as rinsing liquid after effecting silver complex diffusion transfer processing.

The following comparative example illustrates the present invention without, however, limiting it thereto.

All parts, ratios and percentages are by weight unless otherwise stated.

EXAMPLE

An opaque polyvinyl chloride sheet having a thickness of 200 μm was treated with an electrical discharge produced by a corona-discharge apparatus operated under the following conditions:

film-travelling speed: 20 m/min,
electrode spacing to film surface: 2 mm,
corona current: 0.55 A,
AC-voltage difference (peak value): 10 kV,
frequency: 30 kHz.

The corona-treated surface was coated with the following composition to form samples of image receiving materials only differing by the absence or presence of a particular black-toning agent identified furtheron:

| | |
|---|---|
| water | 543.1 ml |
| 3% aqueous dispersion of colloidal $Ag_2S.NiS$ nuclei | 14 ml |
| 30% aqueous dispersion of colloidal silica (average particle size 0.025 um, pH: 8) | 250 ml |
| 5% solution of siloxane compound no. 7 in ethanol | 50 ml |
| 4% aqueous solution of formaldehyde | 10 ml |
| 13.4% aqueous dispersion of caseine | 200 ml |
| 5% aqueous solution of ammonium perfluorocaprilate | 2 ml |
| Black-toning agent (added as 1 wt. ethanolic solution) | 15 ml |

Said compositions were each applied at a wet coverage of 26.3 $m^2/l$ and dried.

Sample 1 did not contain a black-toning agent.

The samples 2 ti 4 contained compounds Nos. 1, 2 and 3 respectively.

The samples 5 to 8 contained compounds Nos. 4, 5, 6 and 7 respectively.

The samples 9 and 10 contained the compounds (III) and (IV) respectively.

Samples 11 and 12 contained compounds 10 and 11 respectively.

Sample 13 contained a black-toning agent X according to U.S. Pat. No. 3,160,505 having the following structural formula:

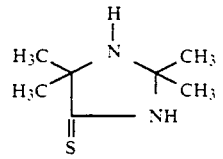

By the common silver complex DTR-process a black-and-white silver image serving for identification purposes was produced in each sample.

On the imaged and dried image-receiving layers a transparent polyvinyl chloride sheet of 60 μm previously being coated at one side with a polyethylene sheet of 30 μm was laid and laminated with the polyethylene in contact with the image-receiving layer. For lamination flat steel plates were used pressing the layers together under a pressure of 10 $kg/cm^2$ at a temperature of 135° C.

The image contained in the thus obtained laminates was protected against forgery not only by the good sealing but also by the crosslinking reaction taking place in the image-receiving layer making that layer impermeable to aqueous silver etching liquids.

Evaluation of image tone quality

Following a visual assessment of the image tone of the laminated samples rating numbers from 1 to 6 (wherein the highest number indicates the less neutral black image tone) were given. These rating numbers are listed in Table 3 hereinafter.

TABLE 3

| Sample No. | Compound No. | Rating number |
|---|---|---|
| 1 | — | 6 |
| 2 | 1 | 1 |
| 3 | 2 | 1-2 |
| 4 | 3 | 3 |
| 5 | 4 | 2 |
| 6 | 5 | 3 |
| 7 | 6 | 1 |
| 8 | 7 | 2 |
| 9 | (III) | 3 |
| 10 | (IV) | 1 |
| 11 | 10 | 2 |
| 12 | 11 | 3 |
| 13 | X | 5 |

In the laminated samples 2 to 12 the spectral density measured in the wavelength range of 400 to 700 nm was not lower than the spectral density measured in said samples before lamination, whereas in the samples 1and 13 a spectral density drop of about 0.1 was measured at 700 nm corresponding with the reddish-brown image tone of said samples.

We claim:

1. A process for the production of a laminated article including a sheet support bearing a silver image produced by the silver complex diffusion transfer process in a layer containing development nuclei, wherein said image is heat laminated with a protective thermoplastic resin layer or sheet that covers said supported silver image, and wherein said layer containing development nuclei contains said silver image during the heat-lamination procedure in the presence of one or more heterocyclic thione compounds or tautomeric thiol representatives thereof acting as black-toning agents and corresponding to one of the following general or structural formulae (I) to (V):

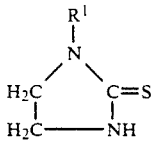

(I)

wherein $R^1$ represents a C1-C4 alkyl group, an allyl group or a phenyl group;

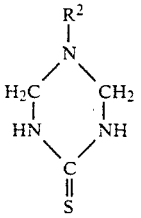

(II)

wherein $R^2$ represents a C1-C4 alkyl group or an allyl group;

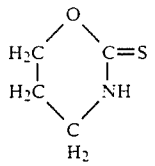

(III)

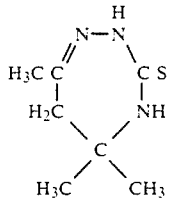

(IV)

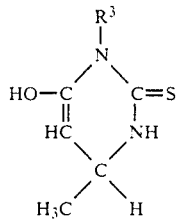

(V)

wherein $R^3$ represents a C1-C4 alkyl group or a phenyl group.

2. A process according to claim 1, wherein for haven said silver image during lamination in the presence of at least one of said black-toning agents, said black-toning agent(s) is (are) incorporated in the coating composition of the development nuclei layer so as to obtain a coverage in the range of 0.0015 g/m$^2$to 0.0075 g/m$^2$.

3. A process according to claim 1, wherein at least one of said black-toning agents before lamination is brought into the presence of said silver image by impregnation of the DTR-processed development nuclei containing layer with an aqueous liquid containing said black-toning agent(s) in dissolved form In a concentration in the range of 0.05 to 0.5 g per liter.

4. A process according to claim 1, wherein before or during the treatment with said black-toning agents the development nuclei containing layer is treated with an aqueous liquid containing a dissolved surfactant.

5. A process according to claim 4, wherein the surfactant is an anionic or a non-ionic surface-active agent containing a polyethyleneoxide chain in its structure.

6. A process according to claim 1, wherein the development nuclei containing layer contains colloidal silica as binding agent.

7. A process according to claim 1, wherein the development nuclei containing layer contains a proteinaceous binding material which after formation of the silver image is treated with a compound serving as hardening agent for the proteinaceous material.

8. A process according to claim 1, wherein the support of the development nuclei containing layer is a thermoplastic vinyl chloride polymer support.

9. A process according to claim 1, wherein the protective cover for the DTR-processed development nuclei containing layer is a transparent sheet made of cellulose acetate butyrate, a cellulose triacetate, a polyvinyl chloride, a polymerized polyethylene glycol ester, a polyolefin, or a polyolefin-coated polyester.

10. A process according to claim 1, wherein the lamination proceeds by introducing the elements to be assembled between flat steel plates or in the nip of pressure rollers under a pressure of 5 to 10 kq per cm$^2$ at a temperature in the range of 100° to 150 ° C.

* * * * *

UNITED STATES PATENT AND TRADEMARK OFFICE

CERTIFICATE OF CORRECTION

PATENT NO. : 5,043,245

DATED : August 27, 1991

INVENTOR(S) : Leon L. Vermuelen et al

It is certified that error appears in the above-identified patent and that said Letters Patent is hereby corrected as shown below:

Col. 12, Claim 2, line 27, Change "haven" to --having--.

Signed and Sealed this

Third Day of November, 1992

*Attest:*

DOUGLAS B. COMER

*Attesting Officer*

*Acting Commissioner of Patents and Trademarks*